US012644245B2

(12) United States Patent
Cheng et al.

(10) Patent No.: US 12,644,245 B2
(45) Date of Patent: Jun. 2, 2026

(54) WATER SURFACE AUTOMATIC CLEANING APPARATUS

(71) Applicant: Shenzhen Aiper Intelligent Co., Ltd., Shenzhen (CN)

(72) Inventors: Chunlin Cheng, Shenzhen (CN); Yuxiang Sun, Shenzhen (CN); Dejian Lai, Shenzhen (CN); Jiaqing Zhang, Shenzhen (CN)

(73) Assignee: Shenzhen Aiper Intelligent Co., Ltd., Shenzhen (CN)

( * ) Notice: Subject to any disclaimer, the term of this patent is extended or adjusted under 35 U.S.C. 154(b) by 0 days.

(21) Appl. No.: 19/257,018

(22) Filed: Jul. 1, 2025

(65) Prior Publication Data

US 2025/0327258 A1 Oct. 23, 2025

Related U.S. Application Data

(63) Continuation of application No. 19/070,645, filed on Mar. 5, 2025, now Pat. No. 12,378,741, which is a (Continued)

(30) Foreign Application Priority Data

| | | |
|---|---|---|
| Feb. 17, 2023 | (CN) | 202310172220.1 |
| Jul. 6, 2023 | (CN) | 202321759097.5 |
| Jul. 10, 2023 | (CN) | 202321801371.0 |

(51) Int. Cl.
*E02B 15/10* (2006.01)
*B63B 35/32* (2006.01)
(Continued)

(52) U.S. Cl.
CPC ..... *E02B 15/10* (2013.01); *B63B 35/32* (2013.01); *E04H 4/1263* (2013.01); *E04H 4/1654* (2013.01); *B63B 2035/007* (2013.01)

(58) Field of Classification Search
CPC ... E02B 15/10; B63B 35/32; B63B 2035/007; E04H 4/1263; E04H 4/1654
(Continued)

(56) References Cited

U.S. PATENT DOCUMENTS

| | | | |
|---|---|---|---|
| 3,708,070 | A | 1/1973 | Bell |
| 3,929,644 | A | 12/1975 | Fletcher |

(Continued)

FOREIGN PATENT DOCUMENTS

| | | | |
|---|---|---|---|
| AU | 2003215436 | A1 | 10/2003 |
| CN | 1530509 | A | 9/2004 |

(Continued)

OTHER PUBLICATIONS

Machine-generated English translation of CN 115584708, generated on Aug. 20, 2025.*

(Continued)

*Primary Examiner* — Fred Prince
(74) *Attorney, Agent, or Firm* — Volpe Koenig

(57) ABSTRACT

The present disclosure discloses a water surface automatic cleaning device, including a main body, a cavity is provided in the main body; and a garbage bin is disposed at the cavity, an inlet is disposed on a sidewall of the garbage bin, and an anti-leakage baffle is configurated to open or close at least a part of area of the inlet.

21 Claims, 8 Drawing Sheets

Related U.S. Application Data continuation of application No. PCT/CN2023/143097, filed on Dec. 29, 2023.

(51) Int. Cl.

| | |
|---|---|
| ***E04H 4/12*** | (2006.01) |
| ***E04H 4/16*** | (2006.01) |
| *B63B 35/00* | (2020.01) |

(58) Field of Classification Search

USPC ..... 210/167.1, 167.19, 167.2, 242.1

See application file for complete search history.

(56) References Cited

U.S. PATENT DOCUMENTS

| | | | | |
|---|---|---|---|---|
| 5,106,492 | A | 4/1992 | Distinti et al. | |
| 5,788,850 | A | 8/1998 | Tuomey | |
| 7,101,475 | B1 | 9/2006 | Maaske | |
| 12,378,741 | B2 * | 8/2025 | Cheng | B63B 35/32 |
| 2003/0201218 | A1 | 10/2003 | Henkin | |
| 2006/0102532 | A1 * | 5/2006 | Cadotte | E04H 4/1654 210/94 |
| 2017/0175410 | A1 | 6/2017 | Smith | |
| 2020/0095743 | A1 | 3/2020 | Shuai | |

FOREIGN PATENT DOCUMENTS

| | | | | | |
|---|---|---|---|---|---|
| CN | 202038437 | U | | 11/2011 | |
| CN | 202368779 | U | | 8/2012 | |
| CN | 204030355 | U | | 12/2014 | |
| CN | 207972758 | U | | 10/2018 | |
| CN | 109204723 | A | | 1/2019 | |
| CN | 109853504 | A | | 6/2019 | |
| CN | 110306504 | A | * | 10/2019 | E02B 15/10 |
| CN | 111003111 | A | | 4/2020 | |
| CN | 111058432 | A | | 4/2020 | |
| CN | 111452924 | A | | 7/2020 | |
| CN | 212766664 | U | | 3/2021 | |
| CN | 213323590 | U | | 6/2021 | |
| CN | 215043530 | U | | 12/2021 | |
| CN | 215562477 | U | | 1/2022 | |
| CN | 114790729 | A | | 7/2022 | |
| CN | 115506323 | A | | 12/2022 | |
| CN | 115584708 | A | * | 1/2023 | E02B 15/10 |
| EP | 0285570 | A1 | | 10/1988 | |
| GB | 866659 | A | | 4/1961 | |
| KR | 10-1416657 | B1 | | 7/2014 | |
| KR | 10-2443105 | B1 | | 9/2022 | |
| WO | 0027694 | A1 | | 5/2000 | |
| WO | 2018120827 | A1 | | 7/2018 | |
| WO | WO-2025113507 | A1 | * | 6/2025 | G05D 1/648 |

OTHER PUBLICATIONS

Machine-generated English translation of WO 2025/113507, generated on Sep. 25, 2025.*

Machine-generated English translation of CN 110306504, generated on Sep. 25, 2025.*

Chinese Office Action issued on Apr. 25, 2025 or Chinese Patent Application No. 202310172220.1.

Zeng, Y., et al., "Design Research of a Floating Garbage Cleaning Machine for Water Surfaces", Central South University, China, Abstract, (2013).

Australian Examination Report issued on May 30, 2025 for Australian Patent Application No. 2023431461.

Australian Notification of Material Filed Under Section 27(1) issued on Jul. 15, 2025 for Australian Patent Application No. 2023431461.

Australian Notification of Further Material Filed Under Section 27(1) issued on Jul. 28, 2025 for Australian Patent Application No. 2023431461.

Australian Examination Report on Voluntary Amendments issued on Sep. 9, 2025 for Australian Patent Application No. 2023431461.

Written Opinion of the International Searching Authority issued on Aug. 15, 2025 for PCT Patent Application No. PCT/CN2023/143097.

European Search Report issued on Feb. 9, 2026 for European Patent Application No. 25198275.7.

Extended European Search Report issued on Feb. 20, 2026 for European Patent Application No. 23922546.9.

Australian First Examination Report issued on Mar. 24, 2026, for Australian Patent Application No. 2025230796.

* cited by examiner

WATER SURFACE AUTOMATIC CLEANING APPARATUS

CROSS-REFERENCE TO RELATED APPLICATION

This present application is a continuation of U.S. patent application Ser. No. 19/070,645, filed Mar. 5, 2025, which is a continuation of International Application No. PCT/CN2023/143097, filed on Dec. 29, 2023. The International Application claims priority to Chinese Patent Application No. 202310172220.1 filed on Feb. 17, 2023, Chinese Patent Application No. 202321759097.5 filed on Jul. 6, 2023, and Chinese Patent Application No. 202321801371.0 filed on Jul. 10, 2023. All of the aforementioned applications are hereby incorporated by reference in their entireties.

FIELD

The present disclosure relates to the technical field of water cleaning apparatus, and in particular, to a water surface cleaning robot.

BACKGROUND

The water surface cleaning robot moves on the water to collect the garbage into the interior garbage bin, so as to clean and collect the garbage on the water surface.

The water surface cleaning robot has been extensively applied into swimming pools. The existing water surface cleaning robot in general is provided with a fixed top cover structure. In such case, it is inconvenient to remove the garbage bin. Further, in some water surface cleaning robots, the top cover is rotatably connected with the main body by a hinge. However, the hinge structure is prone to accidental damage.

SUMMARY

Technical Problem

The technical problem to be solved by the present disclosure is to provide a durable water surface cleaning robot with easy removal of garbage bin.

Technical Solution

To solve the above technical problem, the technical solution adopted by the present disclosure is a water surface automatic cleaning apparatus, comprising a main body, a cavity is provided in the main body; and a garbage bin is disposed at the cavity, an inlet is disposed on a sidewall of the garbage bin, and an anti-leakage baffle is configurated to open or close at least a part of area of the inlet.

Advantageous Effects

The present disclosure achieves following advantageous effects: the top cover is slidably connected with the main body. The cavity is opened and closed by sliding the structure of the top cover, which not only facilitates the removal of the garbage bin, but also has a small lever effect at the joint between the top cover and the main body is low, so that the accidental damage is not easy to occur, thereby being beneficial to extend the service life of the water surface cleaning robot. The anti-stranding device is disposed, which can effectively prevent the stranding and ensure that the water surface cleaning robot can work stably for a long time. When the top cover slides to open, the handle on the garbage bin automatically pops up to make it easy for the users to remove the garbage bin; besides, in a case where the top cover is closed, the handle is driven by the top cover to automatically put down. In such case, the users no longer need to operate the handle, which facilitates the user operation and enhances the usage experience of the user. The garbage bin is opened on its bottom to facilitate cleaning by the users.

DETAILED DESCRIPTION OF EMBODIMENTS

To elaborate technical contents, objectives achieved and effects of the present disclosure, implementations are described below with reference to the accompanying drawings.

Referring to FIGS. 1 to 20, the embodiments of the present disclosure provide a water surface cleaning robot that can be used to clean garbage on a water surface and at a position near the water surface of a water body.

Figure 1:
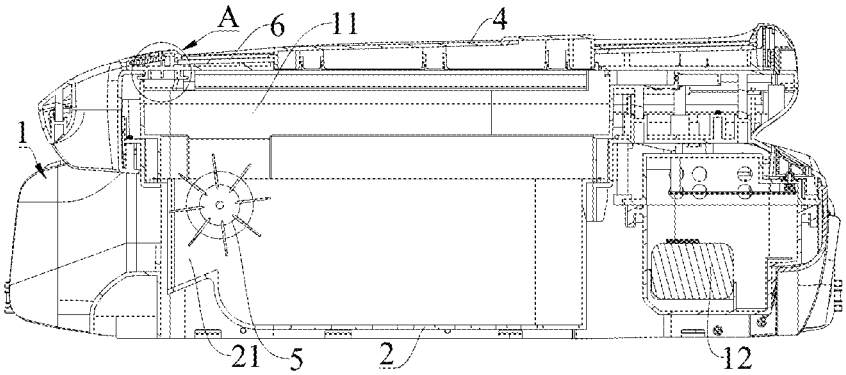
FIG. 1 is a sectional view of a first water surface cleaning robot of the present disclosure.
Figure 2:
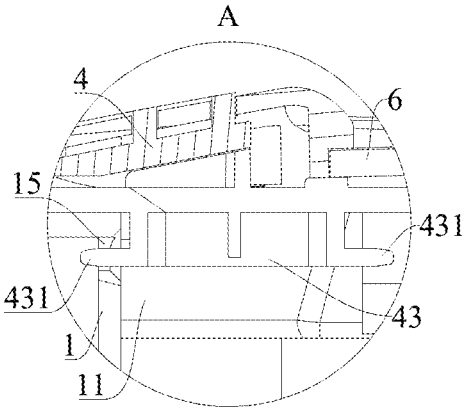
FIG. 2 is an enlarged view of detail A in FIG. 1.
Figure 5:
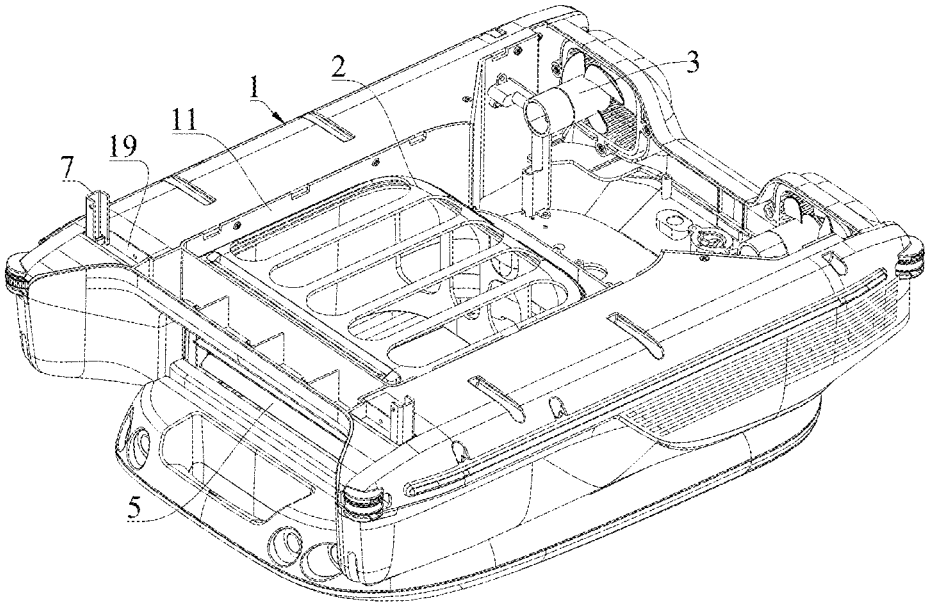
FIG. 5 is a structural schematic diagram of a second water surface cleaning robot of the present disclosure in a first direction.
Figure 8:
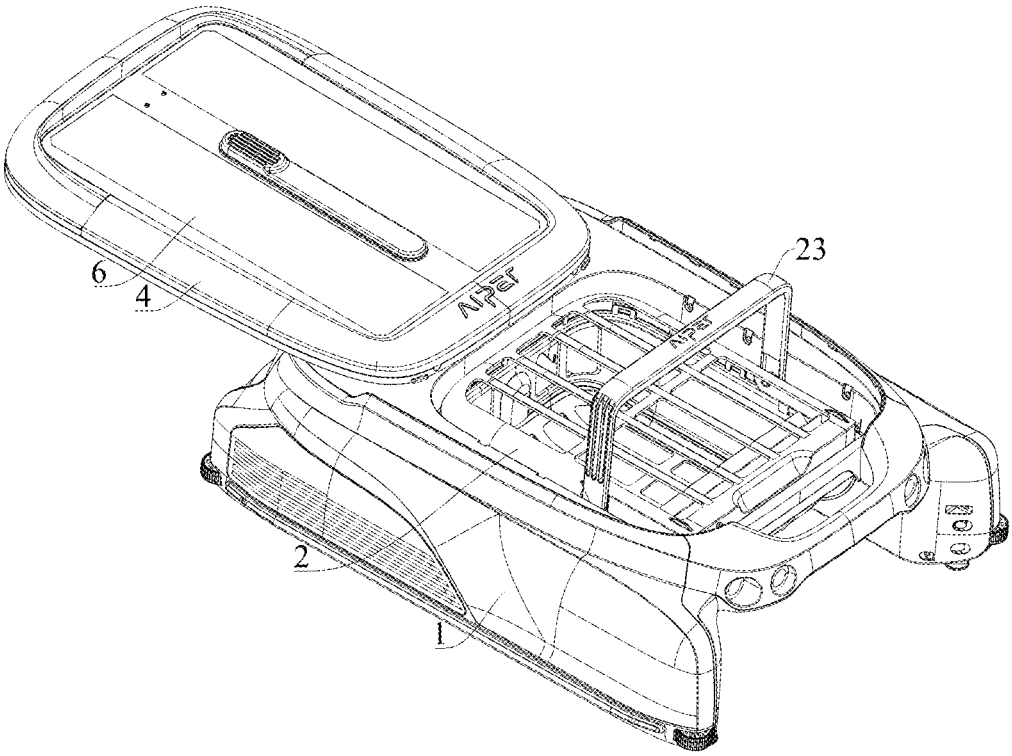
FIG. 8 is a structural schematic diagram of a second water surface cleaning robot of the present disclosure in a second direction.

According to FIGS. 1, 5 and 8, the water surface cleaning robot includes a main body 1, a garbage bin 2 and at least one driving mechanism 3, where a cavity 11 is provided in the main body 1, the garbage bin 2 is disposed at the cavity 11; and the driving mechanism 3 is disposed on the main body 1 for driving the main body 1 to move on the water surface. In an implementation, the driving mechanism 3 is disposed at a rear of the main body 1.

The water surface cleaning robot further includes a top cover 4, the top cover 4 is slidably disposed on a top of the main body 1. The top cover 4 can slide between closed position and open position. When the top cover 4 is at the closed position, the top cover 4 covers the cavity 11, and a user cannot remove the garbage bin 2 from the cavity 11. When the top cover 4 is at the open position, the users may remove the garbage bin 2 from the cavity 11.

The top cover 4 is slidably connected to the main body 1. By sliding a structure of the top cover 4, the opening or closing of the cavity is realized. This not only facilitates the removal of the garbage bin 2, but also has a small lever effect at a joint between the top cover 4 and the main body 1, so that the accidental damage is not easy to occur, thereby being beneficial to extend the service life of the water surface cleaning robot.

Referring to FIGS. 1 to 4, a first limit structure 431 is provided on the top cover 4, and a second limit structure 15 matching with the first limit structure 431 is disposed on the main body 1. The first limit structure 431 is an insertion block, the second limit structure 15 is an insertion hole, and the insertion block is disposed along a sliding direction of the top cover 4; alternatively, the first limit structure 431 is an insertion hole, the second limit structure 15 is an insertion block, and the insertion block is disposed along a sliding direction of the top cover 4. A mating between an insertion block and an insertion groove can prevent an offset of the top cover 4 in a vertical direction, thereby being beneficial to ensure the structural stability of the water surface cleaning robot.

Specifically, the second limit structures 15 are respectively disposed on two opposite sidewalls of the cavity 11, and at least two first limit structures 431 are provided on the top cover 4. One part of the first limit structure 431 matches with the second limit structure 15 on one sidewall of the cavity 11, and the other part of the first limit structure 431 matches with the second limit structure 15 on the other sidewall of the cavity 11. In an implementation, a base body 43 is disposed on the top cover 4, and the first limit structures 431 are respectively provided at a front side of the base body 43 and a rear side of the base body 43. In an implementation, a sidewall of the cavity 11 is provided with an avoidance groove 16 that is used to avoid the base body 43, such that the top cover 4 can be opened and closed within a broader range. The top cover 4 can be limited regardless of whether the top cover 4 is at the closed position or the open position, so as to more adequately prevent a vertical offset of the position of the top cover 4.

Figure 3:
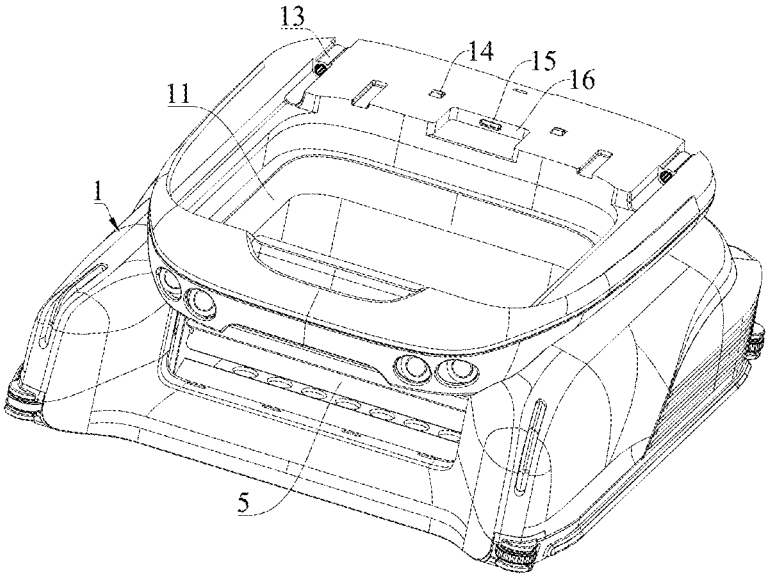
FIG. 3 is a structural schematic diagram of a main body in a first water surface cleaning robot of the present disclosure.
Figure 4:
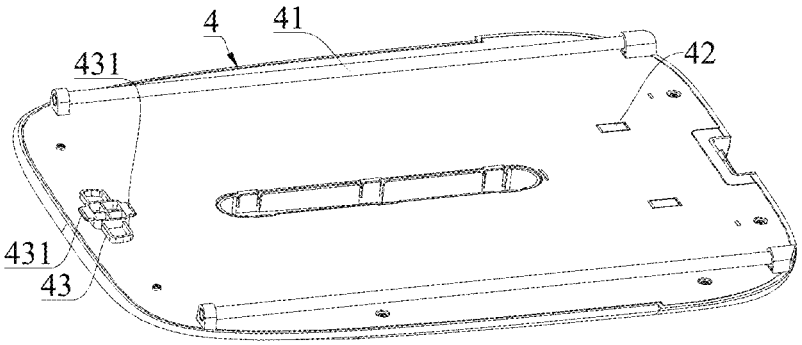
FIG. 4 is a structural schematic diagram of a top cover in a first water surface cleaning robot of the present disclosure.

According to FIGS. 3 and 4, in this embodiment, the top cover 4 is provided with a guide rod 41 and the main body 1 is provided with a guide sleeve 13. The guide rod 41 matches with the guide sleeve 13, so that the top cover 41 is slidably connected to the main body 1. In an implementation, a groove for accommodating the guide rod 41 is disposed on the main body 1 and the guide sleeve 13 is disposed in the groove. The arrangement of the groove may save space and downsize the volume of the water surface cleaning robot. Meanwhile, the groove can play the role of protecting the guide rod 41 to a certain extent. In other embodiment, the main body 1 is provided with the guide rod 41 and the top cover 4 is provided with the guide sleeve 13. The guide rod 41 matches with the guide sleeve 13, so that the top cover 41 is slidably connected to the main body 1. The matching between the guide rod 41 and the guide sleeve 13 allows the top cover 4 to linearly slide between the closed position and the open position. Moreover, the user operation becomes more convenient and smooth, thereby being beneficial to enhance the user experience.

It can be understood that in an implementation, at least two sets of guide sleeves 13 are provided on the main body 1. When two ends of the guide rod 41 are respectively moved and clamped to corresponding sets of guide sleeves, the top cover 4 is limited. Because of the matching between the guide sleeve 13 and the guide rod 41, other movements of the top cover 4 except for the movement along an extended direction of the guide rod 41 are limited. Specifically, a recess for accommodating the guide rod 41 is provided in the top cover 4, and the guide sleeve 13 is disposed to protrude from the main body 1.

As shown in FIG. 5, specifically, a controller is disposed in the main body 1, and the controller is electrically connected to the driving mechanism 3. In an implementation, the driving mechanism 3 includes a driving motor and a propeller 31, where an output end of the driving motor is connected to the propeller 31, and the controller is electrically connected to the driving motor.

Figure 6:
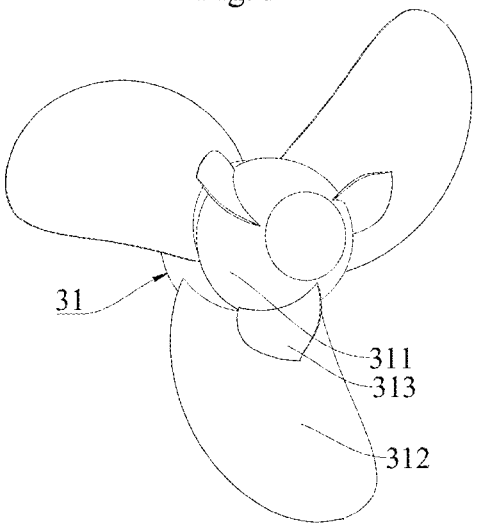
FIG. 6 is a structural schematic diagram of a propeller in a water surface cleaning robot of the present disclosure.

According to FIG. 6, further, the propeller 31 includes a hub 311 and a blade 312 disposed on an outer periphery of the hub 311. The blade 312 is a component from which the propeller 31 produces thrust. In an implementation, a vortex absorbed fin 313 is disposed at a rear of the hub 311 of the propeller 31. A tilting direction of the vortex absorbed fin 313 is identical to that of the blade 312, and both are left-handed or right-handed. In an implementation, a rotation angle of the vortex absorbed fin 313 is identical or similar to that of the blade 312. In this embodiment, the number of the vortex absorbed fin 313 is the same as the number of the blade 312; and the vortex absorbed fin 313 and the blade 312 are parallel provided in one-to-one relationship; the vortex absorbed fin 313 has a shape consistent with or similar to the blade 312; a tilting angle of the vortex absorbed fin 313 and a tilting angle of the blade 312 are consistent or close; an axial distance between the vortex absorbed fin 313 and the blade 312 is one-third to one time of a vane radius of the vortex absorbed fin 313; and an area of the vortex absorbed fin 313 is one-fifth to half of an area of the blade 312. In this embodiment, the area of the vortex absorbed fin 313 is one-fourth of the area of the blade 312.

A small vane (i.e., vortex absorbed fin 313) having a given angle and shape are mounted at an appropriate position on the rear (i.e., hub cap) of the hub 311 of the propeller 31. The vortex absorbed fin 313 can straighten a wake flow of the propeller 31, so that the surface water flow almost flows out in a straight line along the vortex absorbed fin and scatters towards the rear of the hub cap, thereby reducing hub vortex cavitation. Since the hub vortex cavitation is reduced, the pressure at the rear of the hub 311 also decreases, and an induced resistance caused by the hub vortex cavitation is reduced as well, thereby enhancing the propulsion efficiency of the propeller 31. In addition, the small vane of the vortex absorbed fin 313 produces a torsion, which decreases a torque of the propeller 31 and produces a thrust to increase the propulsion of the propeller 31. Meanwhile, the vortex absorbed fin 313 also can effectively reduce the noise and the vibration amplitude of the propeller 31 and enhance stability of the water surface cleaning robot in operation (it is demonstrated by related experimental data that a water surface boat equipped with the vortex absorbed fin 313 can save energy by approximately 2% to 5%).

The number of the vortex absorbed fin 313 is the same as the number of the blade 312 on the propeller 31, and the vortex absorbed fins 313 and the blades 312 are disposed in a one-to-one relationship, i.e., the vortex absorbed fins 313 and corresponding blades 312 thereof have the same axial position. In such case, a counter-rotating vortex is formed, which may induce upwash of internal airflow of the vortex absorbed fin 313. According to Newton's Third Law of Motion (action and reaction), the upwash airflow inside the propeller 31 equipped with the vortex absorbed fin 313 may apply a reaction on the vortex absorbed fin 313 (and the propeller 31), i.e., downward pressure and resistance. Such arrangement allows the water surface cleaning robot to better float on the water surface. Besides, the downward pressure is also help to a certain extent when going ashore and climbing steps.

Figure 7:
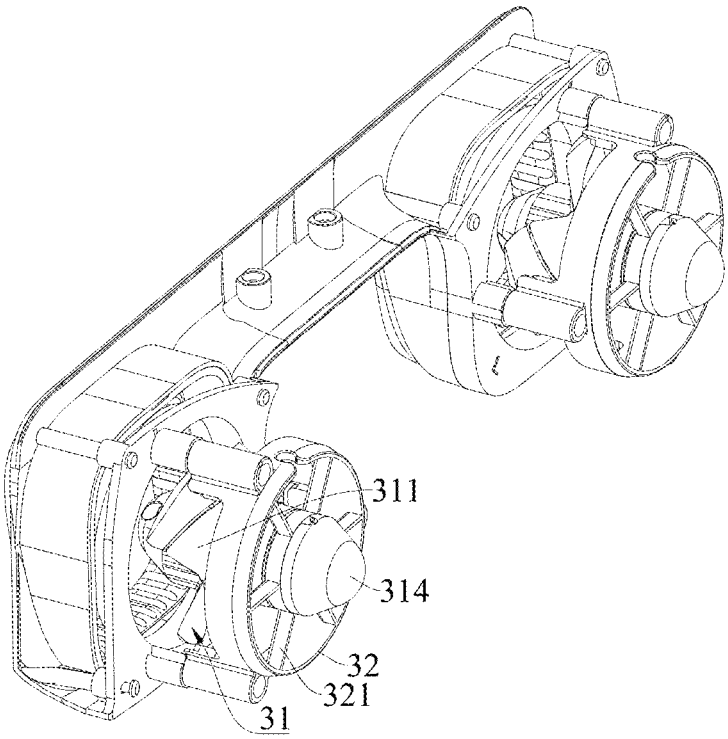
FIG. 7 is a structural schematic diagram of a part of a driving mechanism in a water surface cleaning robot of the present disclosure.

As shown in FIG. 7, in an implementation, the propeller 31 further includes a dome 314, and the dome 314 is disposed at a front of the propeller 31 relative to the hub cap. It can be understood that the terms "front" and "rear" herein are defined with respect to the motion direction of the water surface cleaning robot when advancing. It can be explained that the dome 314 and the hub cap are both in a stream-line structure and a surface curvature thereof is further determined based on the arrangement space and the size of the blade 312. The dome 314 with an arc-shaped outer surface conforms to hydromechanical structures, so as to increase the thrust-weight ratio of the propeller 31 when the pool robot advances and achieve the energy-saving effects. Using only one support frame to support the propeller 31 not only can effectively reduce the hair wrapped around the support frame, but also can ensure the displacement of the propeller 31 and decreases garbage of kinetic energy.

The driving mechanism 3 further includes a fixed frame 32 for fixing the propeller 31. The fixed frame 32 includes a support frame having a plurality of support ribs 321 to support the propeller 31.

As shown in FIGS. 5 and 7, in this embodiment, there are two driving mechanisms 3, and the two driving mechanisms 3 are spaced apart. When the two driving mechanisms 3 operate simultaneously, the robot moves forward; when one driving mechanism 3 works or the rotation speeds of two propellers 31 are not synchronized, the robot can turn.

In some embodiments, the controller may be directly connected to mains supply or a mobile power supply through cables. However, to enable the water surface cleaning robot to move more flexibly, in some embodiments, a rechargeable battery 12 electrically connected to the controller may be disposed in the main body 1 with reference to FIG. 1. In other words, the electric energy of the driving mechanism 3 is supplied by the rechargeable battery 12.

With reference to FIGS. 1, 5, 8 and 9, the garbage bin 2 is provided with an inlet 21. The garbage may go into the garbage bin 2 through the inlet 21 along the water flow, and then remain in the garbage bin 2. The inlet 21 is disposed on a sidewall of the garbage bin 2 close to the front of the main body 1. The garbage bin 2 includes a reset element, a frame 22 and a handle 23. The handle 23 is rotatably connected to the frame 22 and the reset element contacts the frame 22 and the handle 23 respectively. The reset element is used to move the handle 23 from a first position to a second position, where the second position indicates that the handle 23 is in an erect state or near erect state relative to the frame 22. Accordingly, a grip position of the handle 23 is kept at a distance from the frame 22 to facilitate the users to grip the handle 23 by hand, such that the users are less likely to touch the garbage by hand. The reset element 8 includes, but not limited to, a torsion spring and a spring leaf etc. In this embodiment, the reset element 8 is a torsion spring. Specifically, a shaft 231 is disposed on the handle 23, and the handle 23 is rotatably connected to the frame 22 by the shaft 231. The torsion spring is sleeved on the shaft 231 to fulfill its limiting function.

Figure 9:
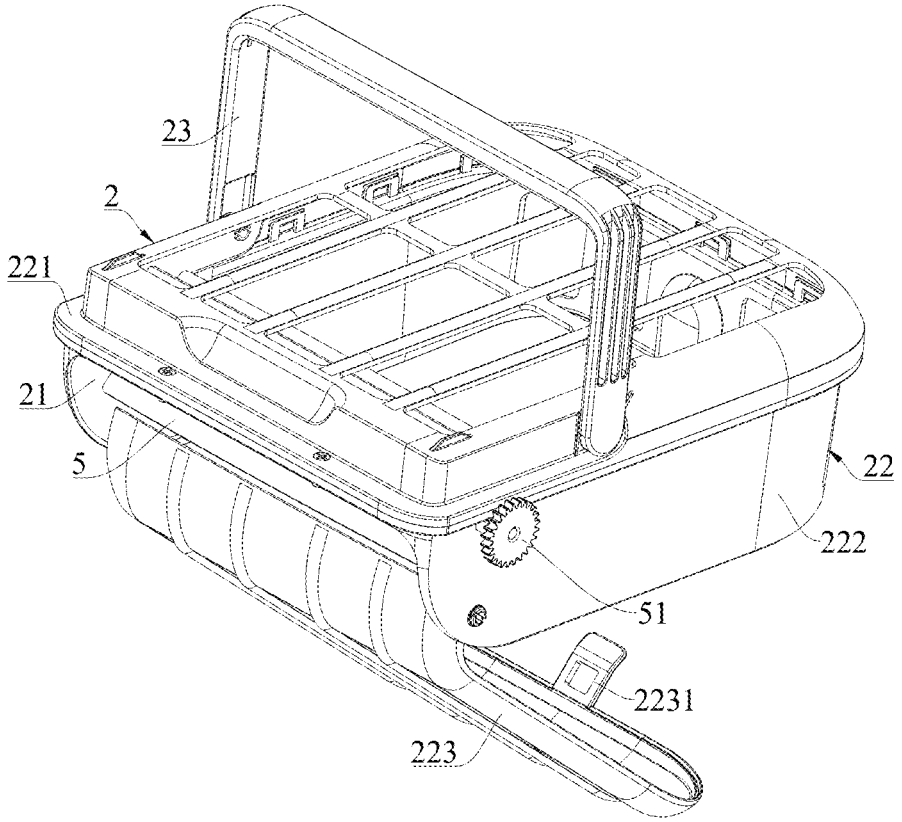
FIG. 9 is a structural schematic diagram of a garbage bin in a water surface cleaning robot of the present disclosure.

According to FIGS. 1 and 8, during the sliding of the top cover 4 from the open position to the closed position, the top cover 4 contacts the handle 23 of the garbage bin 2 inside the cavity 11 and gradually put the handle 23 down. As shown in FIGS. 8 and 9, in order to keep the stress of the frame 22 in a balanced state when a user remove the garbage bin 2, the joint between the handle 23 and the frame 22 is located in a middle region on top of the frame 22. In an implementation, a side of the top of the frame 22 is provided with an accommodating groove 221 for accommodating at least a part of area of the handle 23. The handle 23, after being put down, may be at least partly accommodated in the containing groove 221.

In an implementation, the frame 22 includes a body 222 and a flap 223. The handle 23 is rotatably connected to the body 222. The body 222 has an opening, and the flap 223 is located at the opening. The flap 223 is used to open and close an interior space of the body 222. One end of the flap 223 is rotatably connected to the body 222 and the other end of the flap 223 is provided with a first detachable connecting structure 2231. A second detachable connecting structure matching with the first detachable connecting structure 2231 is provided on the body 222. The inlet 21 is located on a first sidewall of the body 222. The first detachable connecting structure 2231 and the second detachable connecting structure may be buckles, magnetic components, or other structure forms, such as latch structure etc. In an implementation, the body 222 as a whole is in a polygonal frame shape. Accordingly, when the flap 223 is opened, the frame 222 can be completely opened, such that the garbage in the frame 22 can fall smoothly.

In an implementation, an opening of the body 222 is located at a bottom of the body 222, which can prevent the users from touching the garbage by mistake and enhance the usage experience by the users; the second detachable connecting structure is located on a second sidewall of the body 222; the first sidewall is disposed opposite to the second sidewall; and the second wall has a sufficient space to dispose the second detachable connecting structure. In other embodiments, it is also feasible to dispose the opening on the sidewalls of the body 222. In such case, the flap 223 may be considered as a sidewall of the body 222, i.e., a filter basket has a side-open structure.

In some embodiments, one joint between the handle 23 and the body 222 is located on the first sidewall, the other joint between the handle 23 and the body 222 is located on the second sidewall; in this embodiment, one joint between the handle 23 and the body 222 is located on a third sidewall of the body, the other joint between the handle 23 and the body 222 is located on a fourth sidewall of the body; the fourth sidewall is opposite to the third sidewall; the first sidewall is linked to the third sidewall and the fourth sidewall respectively, and the second sidewall is linked to the third sidewall and the fourth sidewall respectively.

With reference to FIGS. 1, 5, 9 and 10, in an implementation, the water surface cleaning robot further includes a rotating element 5, the rotating element 5 is disposed on the main body 1 and the rotating element 5 is disposed close to the inlet 21 of the garbage bin 2. The rotating element 5 is used to feed the garbage in the water to the garbage bin 2. It can be understood that, as shown in FIG. 11, the rotating element 5 may be disposed on the garbage bin 2 and close to the inlet 21 of the garbage bin 2 in some of the specific products.

The inlet 21 is oriented towards the motion direction of the water surface cleaning robot. In this implementation, the inlet 21 and the driving mechanism 3 are respectively disposed on two opposite ends of the main body 1. Specifically, the inlet 21 is disposed at the front of the garbage bin 2, and the driving mechanism 3 is disposed at the rear of the main body 1. It is to be supplemented that the inlets 21 may be respectively disposed at two opposite ends of the garbage bin, such that the garbage may still go into the garbage bin 2 through the inlet 21 along with the water flow when the driving mechanism 3 reverses to move towards another direction. The water surface cleaning robot therefore can collect floating objects in the process of moving forward and backward.

Figure 10:
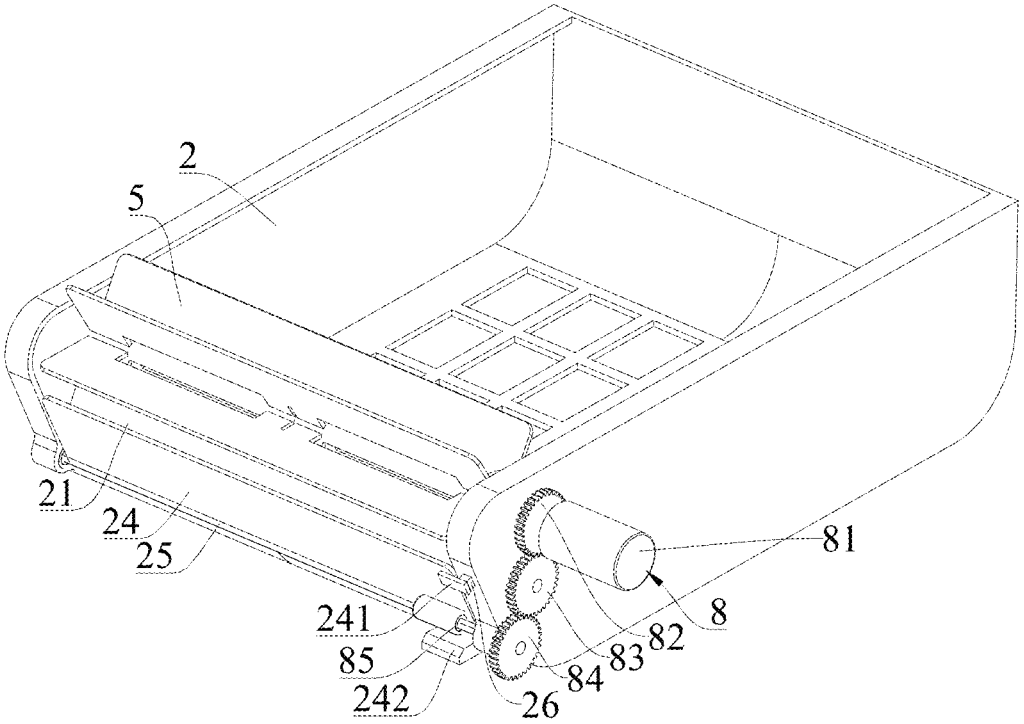
FIG. 10 is a structural schematic diagram of a garbage bin with another structure in a water surface cleaning robot of the present disclosure.

As shown in FIG. 10, to improve cleaning effects of the water surface cleaning robot, in an implementation, a power assembly 8 for driving the rotating element 5 to rotate is provided in the main body 1. The power assembly 8 includes a rotary motor 81 and the like. The power assembly 8 is electrically connected to the controller, and the rechargeable battery 12 supplies electricity to the power assembly 8. It is to be illustrated that when the rotating element 5 is rotatably disposed on the garbage bin 2 through a shaft, and a driving wheel 82 is provided at an end of the shaft. The driving wheel 82 is located on an external side of the garbage bin 2. At this time, the power assembly 8 in the main body 1 drives the rotating element 5 to rotate through the driving wheel 82. The driving wheel 82 includes, but not limited to, drive gear, contact rotary wheel and the like.

Figure 11:
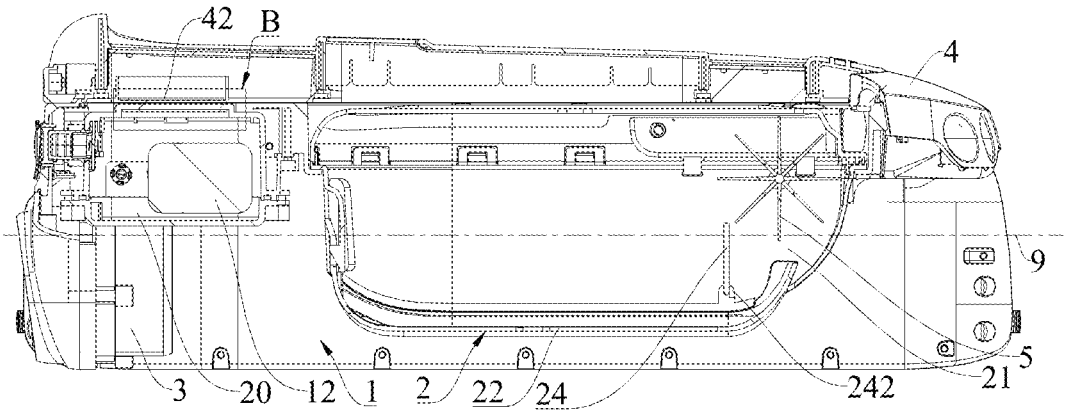
FIG. 11 is a sectional view of a third water surface cleaning robot of the present disclosure.

As shown in FIGS. 10 and 11, to further prevent overflow of the garbage in the garbage bin, in an implementation, an anti-leakage baffle 24 is provided on the garbage bin 2; the anti-leakage baffle 24, when at a predetermined position, closes at least a part of area of the inlet 21.

In an embodiment, a side of the anti-leakage baffle 24 is hinged to the inlet 21 through a shaft lever 25. The shaft lever 25 may be actuated to drive the anti-leakage baffle 24 to rotate around an axis of the shaft lever 25 to cover the inlet 21, thereby achieving the effect of preventing the overflow of the garbage in the garbage bin 2 from the inlet 21.

During the collecting of floating objects, the water surface cleaning robot having the anti-leakage baffle 24 opens the anti-leakage baffle 24, allowing the floating objects to go into the garbage bin 2 under the rotating of the rotating element 5. At this moment, the floating objects can hardly overflow from the inlet 21 because of the action of the water flow. When the collection stops, the inlet 21 is covered by the anti-leakage baffle 24 to avoid overflow of the floating objects. The size of the inlet 21 is designed to be as wide as possible, thereby ensuring the collection efficiency when avoiding again overflow of the floating objects.

As shown in FIG. 10, it can be understood that the anti-leakage baffle 24 and the rotating element 5 may be driven by the same power assembly 8 or different power driving mechanisms in specific products. To simplify the structure, in an implementation, the anti-leakage baffle 24 and the rotating element 5 are driven by the same power assembly 8. Specifically, the power assembly 8 further includes a transmission assembly in transmission connection with the rotary motor 81, where the transmission assembly is in transmission connection with the rotating element 5 and the shaft lever 25 respectively. As a further improvement, the transmission assembly only drives the anti-leakage baffle 24 to rotate towards a direction that covers the inlet 21, and a rotation direction of the rotating element 5 is made to be the same as a rotation direction of the anti-leakage baffle 24.

A limit part 242 is further included. Specifically, the limit part 242 can be disposed on the main body 1 or the garbage bin 2. After the anti-leakage baffle 24 is opened under gravity, the anti-leakage baffle 24 is abutted against the limit part 242. Besides, one end of the anti-leakage baffle 24 away from the inlet 21 is tilting downward. When the anti-leakage baffle 24 is abutted against the limit part 242, an angle between the anti-leakage baffle 24 and a water line is between 15 and 40 degrees, which on one hand can reduce the resistance faced by the water surface cleaning robot during movement and may guide the floating objects to improve the collection efficiency on the other hand.

Practical procedure: the water surface cleaning robot is placed on the water surface and driven by the driving mechanism 3 to move towards a first direction; at this moment, the rotary motor 81 rotates forward, so that the rotating element 5 rotates in a water flow direction, i.e., counter-clockwise rotation; at this moment, a one-way bearing 85 in such case is in a slipping state; the anti-leakage baffle 24 is opened under gravity and the rotating element 5 rotates counter-clockwise to push the garbage into the garbage bin; when the collection stops, the rotary motor 81 reverses to drive the rotating element 5 to rotate clockwise; at this moment, the one-way bearing 85 is in a transmission state to drive the anti-leakage baffle 24 to rotate so as to cover the inlet 21.

As shown in FIG. 11, in another implementation, the anti-leakage baffle 24 further may be disposed near the inlet 21 in the garbage bin 2; the anti-leakage baffle 24 may freely rotate in the garbage bin 2 and may rotate within a range from 0 to 100 degrees with respect to the water flow direction (opposite to the advance direction of the water surface cleaning robot). In a case where an angle between the anti-leakage baffle 24 and the water direction is between 80 to 100 degrees, the anti-leakage baffle 24 is above a water line 9.

In an implementation, the anti-leakage baffle 24 is disposed at a such position that a free end of the anti-leakage baffle 24 is above the water line 9 by 5 to 20 mm when the anti-leakage baffle 24 is perpendicular to the water flow direction, and the free end of the anti-leakage baffle 24 just does not contact a brush vane of the rotating element 5 when it is at a minimum distance to the brush vane of the rotating element 5 during the rotation of the anti-leakage baffle 24.

To simplify the structure of the garbage bin 2, when the water surface cleaning robot stops advancing and floats on the water surface, the anti-leakage baffle 24 resets to the closed position due to its own buoyancy. In an implementation, a material of at least a part of area of the anti-leakage baffle 24 has a density smaller than the water density (a density of 1 g/cm$^3$). While the water surface cleaning robot advances, the water flow would push the anti-leakage baffle 24 to rotate. The anti-leakage baffle 24 then would tilt backward by a certain angle, which correspondingly opens the inlet 21 to allow the garbage to enter smoothly. In a case where the water surface cleaning robot stands still or retreats, the anti-leakage baffle 24 resets to the closed position under the action of buoyancy or water flow. In such case, a top end (i.e., free end) of the anti-leakage baffle 24 is above the water line 9, so as to avoid leakage of the garbage from the garbage bin 2.

To allow the anti-leakage baffle 24 to more rapidly reset to the closed position, in an implementation, an air chamber is provided on the anti-leakage baffle 24. It can be understood that a material density of the anti-leakage baffle 24 may not be smaller than the density of water in such case. In other embodiments, to allow the anti-leakage baffle 24 to more rapidly reset to the closed position, a counterweight is provided on the anti-leakage baffle 24; when the anti-leakage baffle 24 is at the closed position, the counterweight is located below a central rotation axis of the anti-leakage baffle 24, the counterweight may be an additionally configured heavy load or a local area of the anti-leakage baffle 24 having a material density greater than the density of water.

In an implementation, as shown in FIG. 11, the limit part 242 is a limit bump disposed on the frame 22. A range of a rotation angle of the anti-leakage baffle 24 is delimited by the limit part 242. The rotation angle of the anti-leakage baffle 24 ranges from 0 to 100 degrees. When the anti-leakage baffle 24 is in a horizontal state, the rotation angle of the anti-leakage baffle 24 is 0 degree; when the anti-leakage baffle 24 is in a vertical state, the rotation angle of the anti-leakage baffle 24 is 90 degrees. In this embodiment, when the anti-leakage baffle 24 is at an angle between 80 to 100 degrees, a top end of the anti-leakage baffle 24 is always above the water line 9. In other words, in actual products, the closed position of the anti-leakage baffle 24 may correspond to a set of range of the rotation angles, such as between 80 and 100 degrees, rather than an explicit and single numeric value of the rotation angle.

With reference to FIGS. 1-4, 8 and 11-12, in an implementation, the water surface cleaning robot also includes a solar panel 6, the solar panel 6 is disposed on a surface of the top cover 4. A solar controller is provided in the main body 1, and the solar controller is connected to the rechargeable battery 12 and the solar panel 6. As a preferred implementation, a first conducting structure 42 electrically connected to the solar panel 6 is further provided on the top cover 4; and a second conducting structure 14 electrically connected to the rechargeable battery 12 is provided on the main body 1; when the top cover 4 is at the closed position, the first conducting structure 42 and the second conducting structure 14 are electrically conducted; when the top cover 4 is at the open position, the first conducting structure 42 and the second conducting structure 14 remain electrically conducted or are disconnected. The first conducting structure 42 is a metal contact sheet, metal chip, metal probe or a first plug and un-plug connector.

In details, when the top cover 4 is at the open position, a simple method for keeping the first conducting structure 42 and the second conducting structure 14 conducted is to configure the first conducting structure 42 to be a relatively long metal contact sheet, and a length direction of the relatively long metal contact sheet is consistent with the sliding direction of the top cover 4.

In other implementations, the first conducting structure 42 and the second conducting structure 14 also may be selected as existing non-metal electric conducting structures, e.g., magnetically electric conducting structures, thereby avoiding corrosion-prone issues of the metal conducting structure, and beneficial to prolong the service life of the first conducting structure 42 and the second conducting structure 14, and enhance the usage experience of the users.

Figure 12:
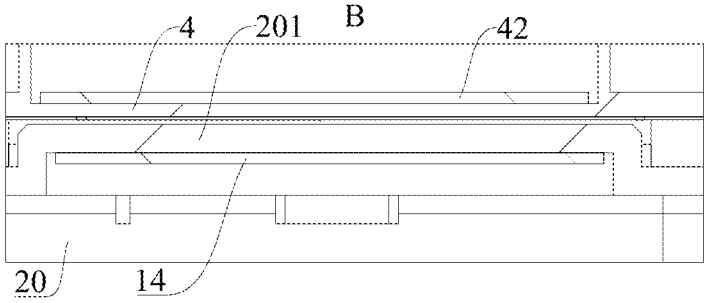
FIG. 12 is an enlarged view of detail B in FIG. 11.

With reference to FIGS. 11-12, in an implementation, the first conducting structure 42 is a wireless charging transmitter module and the second conducting structure 14 is a wireless charging receiver module. Specifically, a seal cabinet 20 is disposed in the main body 1 and the wireless charging receiver module is disposed in the seal cabinet 20. In an implementation, the rechargeable battery 12 is also located in the seal cabinet 20; a circuit board is disposed in the seal cabinet 20 and the wireless charging receiver module and the rechargeable battery 12 are electrically connected to the circuit board respectively.

During manufacturing, after the wiring of the wireless charging transmitter module and the solar panel 6 is completed, the void is sealed with a glue, i.e., the wireless charging transmitter module is sealed and no longer affected by moisture. Since the wireless charging transmitter module is integral to the top cover 4 and the solar panel 6, the wireless charging transmitter module is stationary with respect to the solar panel 6 no matter the top cover is opened or closed. The wireless charging receiver module is installed in the seal cabinet 20. The seal cabinet 20 is water proof, so that the wireless charging receiver module can be directly installed. When the top cover 4 is closed, a position of the wireless charging transmitter module and a position of the wireless charging receiver module are matched to perform wireless charging; as the top cover 4 opens, the wireless charging transmitter module and the wireless charging receiver module are mismatched and the charging stops.

In an implementation, the seal cabinet 20 has a convex part 201 protruding towards the top cover 4; at least a part of the wireless charging receiver module is located in the convex part 201; the arrangement of the convex part 201 not only facilitates positioning and mounting of the wireless charging receiver module, but also reduces a distance between the wireless charging receiver module and the wireless charging transmitter module at a corresponding position, thereby improving the charging efficiency.

The electric energy generated by the solar panel 6 can be utilized by the driving mechanism 3, so as to lower the energy consumption of the water surface cleaning robot and cut down the usage costs of the users. Meanwhile, the solar panel 6 is electrically connected to the driving mechanism 3 by non-cable connection paths, which not only increases aesthetics of the water surface cleaning robot, but also reduces the risks of accidental disconnection of the connection paths between the solar panel 6 and the driving mechanism 3 and extends the service life of the water surface cleaning robot.

In an implementation, a mount groove is disposed on the top surface of the top cover 4 and the solar panel 6 is mounted in the mount groove. In an implementation, the solar panel 6 is mounted in the mount groove in a tilted manner, so as to conveniently discharge the liquid residual in the solar panel 6 and avoid affecting the operation of the solar panel 6. It can be easily understood that the solar panel 6 is mounted in a tilted manner, so that an acute angle is formed between the top surface of the solar panel 6 and the horizontal plane, thereby facilitating the smooth drainage of the liquid attached on solar panel 6.

Figure 13:
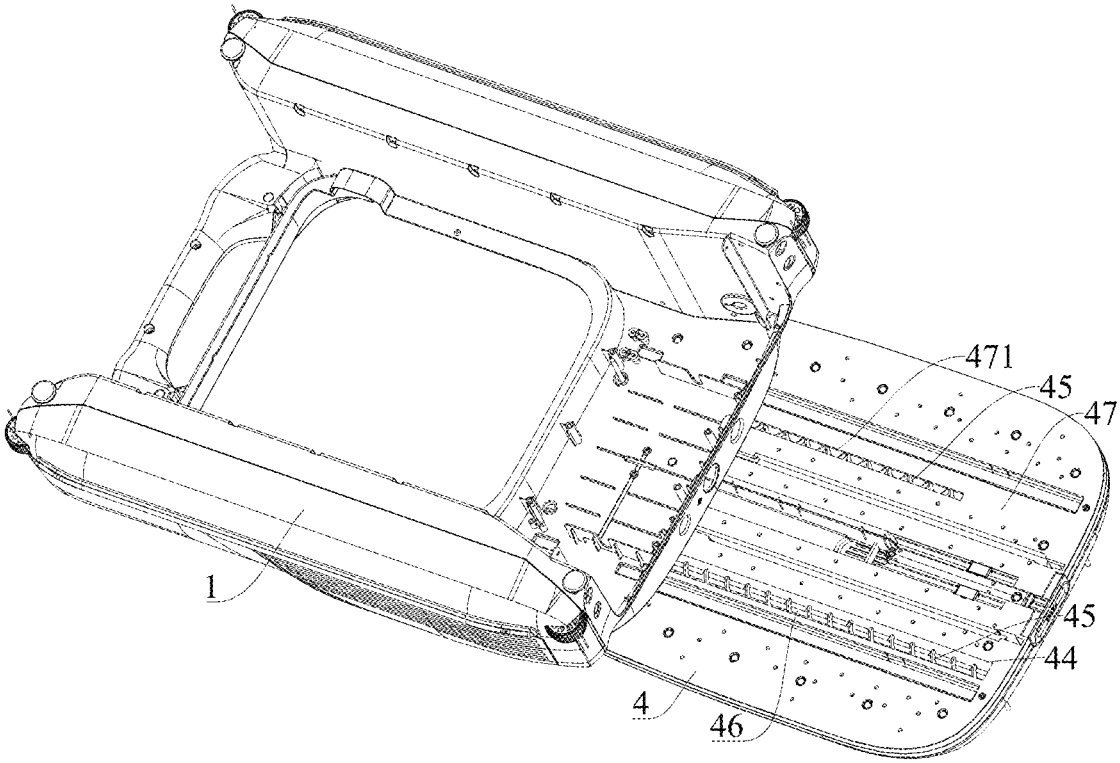
FIG. 13 is a structural schematic diagram of a fourth water surface cleaning robot of the present disclosure (with top cover opened)
Figure 14:
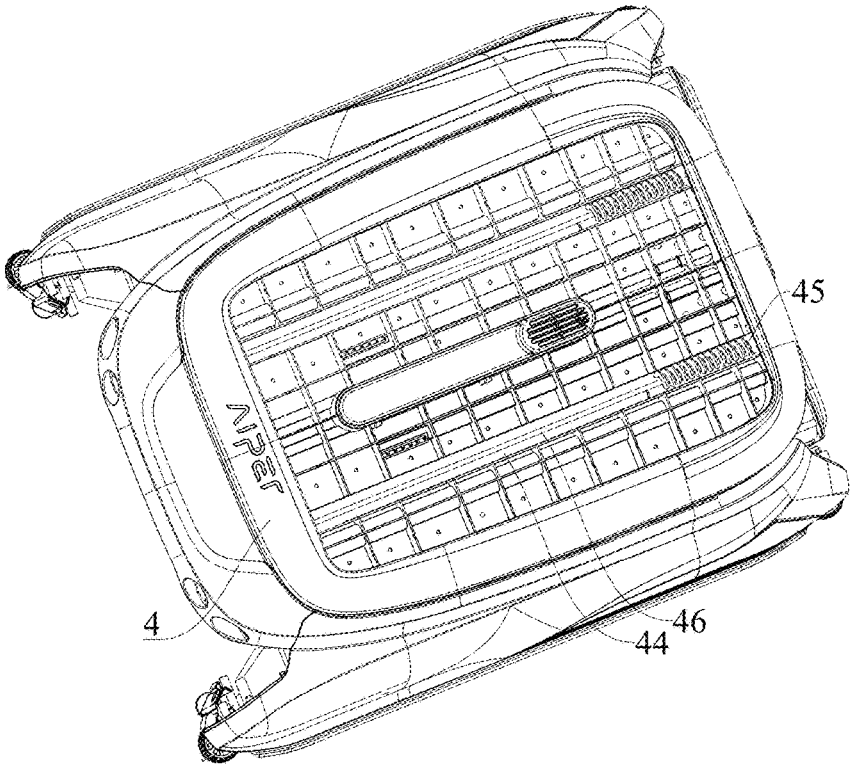
FIG. 14 is a structural schematic diagram of a fourth water surface cleaning robot of the present disclosure (with top cover closed)
Figure 15:
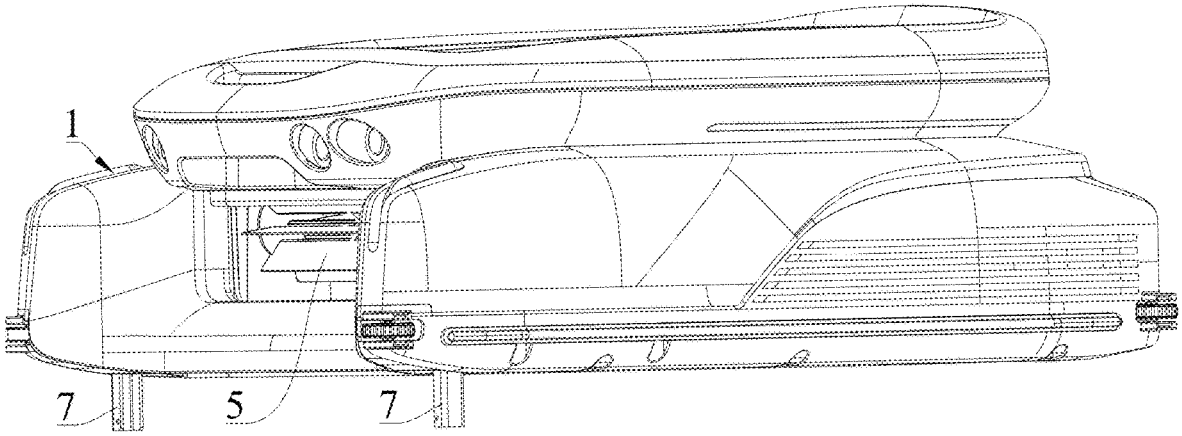
FIG. 15 is a structural schematic diagram of a fifth water surface cleaning robot of the present disclosure.
Figure 16:
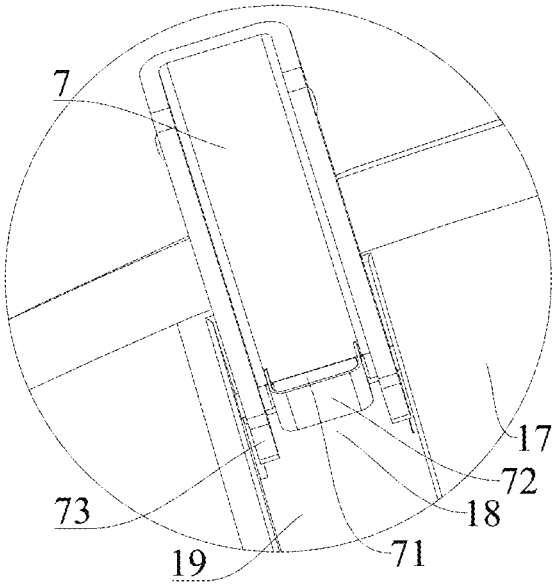
FIG. 16 is a first structural schematic diagram of a part of a fifth water surface cleaning robot of the present disclosure.
Figure 17:
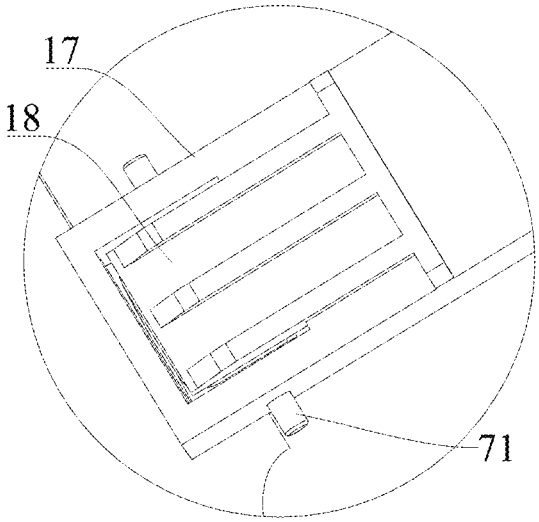
FIG. 17 is a second structural schematic diagram of a part of a fifth type of the water surface cleaning robot of the present disclosure.
Figure 18:
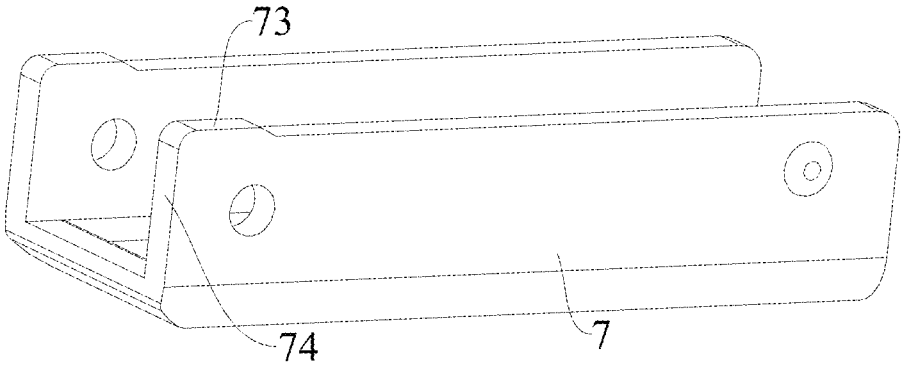
FIG. 18 is a structural schematic diagram of an anti-stranding device of a fifth water surface cleaning robot of the present disclosure.

In another implementation, as shown in FIGS. 13 and 14, the electric energy produced by the solar panel 6 is transmitted via a cable 45 to an electric component in the main body 1, e.g., rechargeable battery 12. Specifically, a cavity 44 for accommodating the cable 45 is disposed in the top cover 4; when the top cover 4 is at the open position, the cable 45 is in a stretching state inside the cavity 44; when the top cover 4 is at the closed position, the cable 45 in the cavity 44 is retracted. By connecting the solar panel 6 to the electric component via the cable 45, the electrolysis and the corrosion issues of the conducting structures are solved and the service life of the conducting structure of the solar panel 6 is effectively prolonged, thereby ensuring the stability of the solar panel 6 in operation.

The cavity 44 has an elongated shape extending along a motion direction of the top cover 4. In an implementation, the cable 45 is orderly accommodated in the cavity 44, and the cable 45 is in helical form. The helical cable may be orderly stretched or retracted in the cavity 44.

Further, a winding post 46, a loading plate 47 or other structures for bearing the helical cable is further provided in the cavity 44. The helical cable may be disposed to surround the winding post 46 or may be placed on the loading plate on account of gravity. In such case, the cable 45 may be better accommodated in the cavity 44, thereby avoiding any unreliable influencing factors induced by an excessively long cable. As an example of setting the winding post 46, when the top cover 4 moves to the closed position from the open position, the stretched cable 45 can be orderly retracted due to the guide of the winding post 46. Accordingly, the pitch gradually reduces and the matching between the winding post 46 and the helical cable can ensure that the cable would not be jammed during the sliding of the top cover 4.

It can be understood that when the loading plate 47 is disposed in the cavity 44, an open slot 471 is provided on the loading plate 47, through which open slot 471 one end of the cable 45 passes to connect to the electric component in the main body 1. A length direction of the open slot 471 is consistent with a sliding direction of the top cover 4, and a length of the open slot 471 is defined by displacement of the top cover 4. The loading plate 47 having the open slot 471 has a simple structure and can be easily processed. In specific production, the loading plate 471 may be formed integral to other parts of the top cover 4 by injection molding, or the loading plate 471 may be linked to the top cover 4 by a fastener depending on the actual requirements.

It can be illustrated that in the accompanying drawings, both the winding post 46 and the loading plate 47 are disposed, to clearly demonstrate different implementations. In specific implementation, only the winding post 46 or the loading plate 47 may be disposed on the top cover 4. In other implementations, the winding post 46 and the loading plate 47 with the open slot 471 also may be configured together depending on the actual requirements.

In a case where the loading plate 47 is provided in the cavity 44, in an implementation, a sectional dimension of the cavity 44 is slightly larger than an outer diameter of the cable 45 in retracted state as a whole. In such case, the cable 45 would not overlap on itself when resetting from the stretching state to the retracted state, so as to ensure that the stretched cable 45 is orderly retracted and the pitch gradually reduces.

It can be illustrated that in specific products, the rechargeable battery 12 may not be provided in products. In such case, the solar controller is connected to the solar panel 6 and the electric component in the water surface cleaning robot, such as the driving mechanism 3 and the rotary motor 81 etc. In other words, the electric component in the water surface cleaning robot is directly powered by the solar panel 6 or the mains supply/mobile power supply assisted by the solar panel 6.

With reference to FIGS. 5 and 15-20, to avoid stranding of the water surface cleaning robot in operation, an anti-stranding device 7 is disposed at the bottom of the main body 1. In an implementation, there is a plurality of anti-stranding devices 7. In this embodiment, there are two anti-stranding devices 7, and the anti-stranding devices 7 is disposed respectively close to the left side and the right side of the main body 1. In other embodiments, there may be four or more anti-stranding devices 7; in a case where four anti-stranding devices 7 are provided, each of the opposite ends of the main body 1 is disposed with two anti-stranding devices 7.

In some embodiments, the anti-stranding device 7 may be a collision sensor, a distance measuring sensor or other types of sensors. In a case where the anti-stranding device 7 is a collision sensor, the collision sensor transmits a collision signal to the controller, the controller controls the machine to retreat or turn; in a case where the anti-stranding device 7 is a distance measuring sensor, the distance measuring sensor transmits information of the distance between the bottom of the main body 1 and the ground to the controller; when the distance information is smaller than a preset threshold, the controller controls the machine to retreat or turn.

In some other embodiments, the anti-stranding device 7 may also be an interference structure in non-electronic sensor type. In such case, the anti-stranding device 7 directly interferes with the structure in the working environment, such as steps, to prevent stranding.

The water surface cleaning robot according to this embodiment prevents stranding by direct interference. Specifically, the anti-stranding device 7 is rotatably connected to the main body 1; in an implementation, a damping structure is disposed at a joint between the anti-stranding device 7 and the main body 1. Of course, it is also feasible to dispose a C-shaped snap spring in contact with the anti-stranding device 7 at the joint between the anti-stranding device 7 and the main body 1. By virtue of the elasticity of the C-shaped snap spring, the anti-stranding device 7 can remain at the open/closed position, thereby being beneficial to improve the working stability of the anti-stranding device 7.

With reference to FIGS. 15-18, in an embodiment, the main body 1 has relatively disposed mounting parts 17. A shaft hole is disposed on the mounting part 17, and a rotary shaft 71 is disposed at the shaft hole. The anti-stranding device 7 is rotatably connected to the main body 1 through the rotary shaft 71, and a limit piece 72 is mounted on the rotary shaft 71 for limiting the axial sliding of the rotary shaft 71. When mounting the anti-stranding device 7, the rotary shaft 71 is first inserted from an external side of one mounting part 17, and one end of the rotary shaft 71 sequentially goes through the anti-stranding device 7 and the other mounting part 17; and the limit piece 72 is then fixed on the rotary shaft 71. In case of axial movement of the rotary shaft 71, the limit piece 72 fixed on the rotary shaft 71 is abutted against the anti-stranding device 7 and/or the mounting part 17, thereby limiting the axial sliding of the rotary shaft 71. In an implementation, the limit piece 72 has a bayonet and the rotary shaft 71 has a bayonet groove matching with the bayonet. The limit piece 72 is connected to the rotary shaft 71 in a bayonet connection, to more conveniently assemble and disassemble the limit piece 72 to and from the rotary shaft 71. In this embodiment, the limit piece 72 is in concave shape, and two bayonets are provided on the limit piece 72. Therefore, the materials consumed for manufacturing the limit piece 72 are reduced and the users can more conveniently assemble and disassemble the limit piece 72.

In an implementation, a section of the anti-stranding device 7 is in a recess shape. In some embodiments, the damping structure may be accommodated in the recess of the anti-stranding device 7. In this embodiment, the limit piece 27 is accommodated in the recess of the anti-stranding device 7.

The water surface cleaning robot further includes a third limit structure, the third limit structure includes a first limit part and a second limit part matching with each other, the first limit part is disposed on the anti-stranding device 7 and the second limit part is disposed on the main body 1. The matching between the first limit part and the second limit part can keep the relative position between the anti-stranding device 7 and the main body 1, thereby avoiding unexpected activities of the anti-stranding device with respect to the main body 1.

In an implementation, the first limit part includes a first abutting surface 73 and a second abutting surface 74 angled to each other, and the second limit part is an elastic abutting part disposed on the main body 1. In this embodiment, the first abutting surface 73 is perpendicular to the second abutting surface 74, and a chamfering structure is disposed at the joint between the first and second abutting surfaces. In details, the elastic abutting part is an elastic arm 18 disposed on the main body 1. In some embodiments, the elastic abutting part may be an elastic pad disposed on the main body 1, where the elastic pad includes, but not limited to, metallic spring pad, rubber pad and the like. In other embodiments, the first limit part and the second limit part also may be in other structure forms, e.g., mated convex and concave structures.

An accommodating slot 19 for accommodating the anti-stranding device 7 is disposed at the bottom of the main body 1. In this embodiment, the mounting part 17 is a sidewall of the accommodating slot 19, and the elastic arm 18 is a part region of the bottom wall of the accommodating slot 19.

Figure 19:
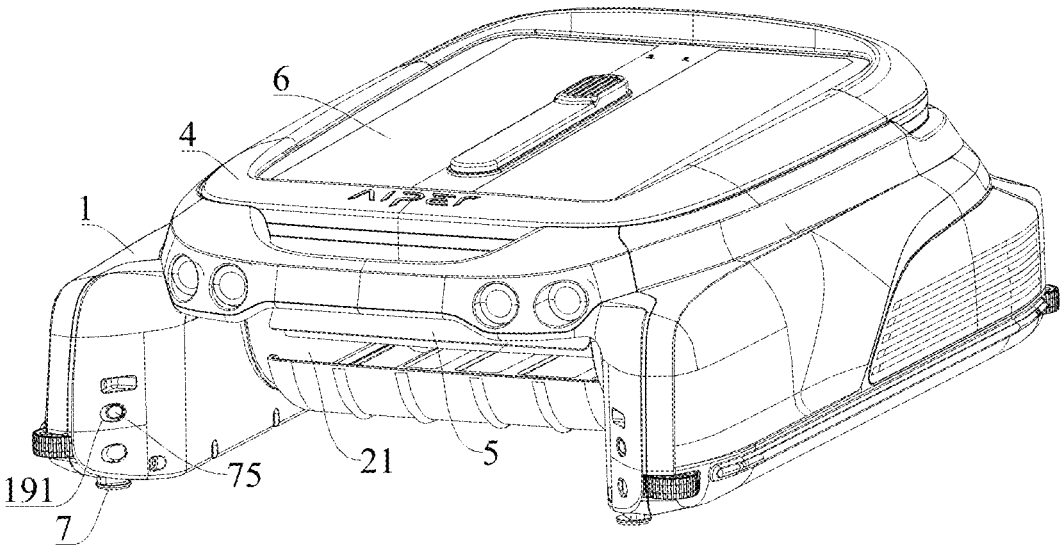
FIG. 19 is a structural schematic diagram of a sixth water surface cleaning robot of the present disclosure in a first direction.
Figure 20:
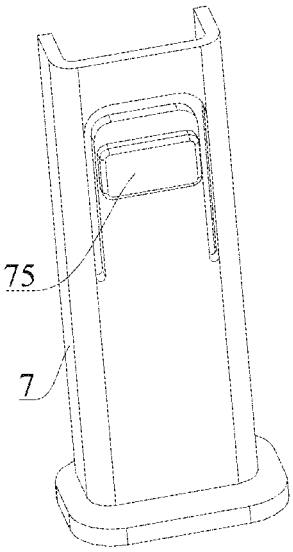
FIG. 20 is a first structural schematic diagram of an anti-stranding device of a sixth water surface cleaning robot of the present disclosure.

The anti-stranding device 7 does not necessarily need to be rotatable with respect to the main body 1 to be retractable. As shown in FIGS. 19 and 20, in other embodiments, it is also feasible that the anti-stranding device 7 is disposed to liftable with respect to the main body 1. In a case where an anti-stranding function of the water surface cleaning robot is turned on, the anti-stranding device 7 descends and protrudes from the accommodating slot 19; when the anti-stranding function of the water surface cleaning robot is turned off, the anti-stranding device 7 ascends and is retracted into the accommodating slot 19.

As an instance of the liftable anti-stranding device 7, the accommodating slot 19 on the main body 1 is in communication with the outside via the bottom surface of the main body 1. In an implementation, the accommodating slot 19 is vertically disposed; an elastic fixture block 75 is disposed on the anti-stranding device; and a plurality of fixture holes 191 in communication with the accommodating slot 19 is disposed on a wall surface of the main body 1; the fixture hole 191 matches with the fixture block 75. In a case where the fixture block 75 matches with different fixture hole 191, the anti-stranding device 7 protrudes by different distances with respect to the bottom of the main body 1; in an implementation, the same accommodating slot 19 is in communication with two of the fixture holes 191; when the fixture block 75 is clamped into one of the fixture holes 191, the anti-stranding device 7 is accommodated in the accommodating slot 19; and in a case where the fixture block 75 is clamped into the other of the fixture holes 191, the bottom end of the anti-stranding device 7 protrudes relative to the bottom surface of the main body 1, thereby playing the anti-stranding role. It can be easily understood that during operations, the users may directly press the fixture block 75 clamped into the fixture hole 191 to unlock the anti-stranding device 7, such that the anti-stranding device 7 may slide along the accommodating slot 19, so as to clamp the fixture block 75 into the other fixture hole 191.

After the anti-stranding device 7 is turned on, the anti-stranding device 7 would be triggered when encountering a step or moving to a shallow water area, so as to transmit the signals to the controller of the water surface cleaning robot. The controller then controls the water surface cleaning robot to retreat or turn to prevent the water surface cleaning robot from rushing into the shallow water area.

In summary, in the water surface cleaning robot provided by the present invention, the top cover is slidably connected with the main body. The cavity is opened and closed by sliding the structure of the top cover, which not only facilitates the removal of the garbage bin, but also has a small lever effect at the joint between the top cover and the main body is low, so that the accidental damage is not easy to occur, thereby being beneficial to extend the service life of the water surface cleaning robot. The anti-stranding device is disposed, which can effectively prevent the stranding and ensure that the water surface cleaning robot can work stably for a long time. When the top cover slides to open, the handle on the garbage bin automatically pops up to make it easy for the users to remove the garbage bin; besides, in a case where the top cover is closed, the handle is driven by the top cover to automatically put down. In such case, the users no longer need to operate the handle, which facilitates the user operation and enhances the usage experience of the user. The garbage bin is opened on its bottom to facilitate cleaning by the users.

The above-described description is merely the implementations of the present disclosure and shall not restrict the patent scope of the present disclosure. Any equivalent substitutions made with reference to the specification and the accompanying drawings of the present disclosure, or directly or indirectly applied into the related technical fields fall within the patent protection scope of the present disclosure.

We claim:

1. A water surface automatic cleaning apparatus, comprising:

a main body comprising a cavity inside;

a garbage bin arranged in the cavity and comprising an inlet on a side of the garbage bin;

an anti-leakage baffle arranged on the main body, and the anti-leakage baffle being configured to allow to open or close at least a part of an area of the inlet by rotating; and a rotating element arranged near to the inlet on the main body and configured to feed garbage in water into the garbage bin by rotating, wherein in a direction parallel to a forward direction of the water surface automatic cleaning apparatus, a shaft lever for the anti-leakage baffle does not directly face the rotating element.

2. The water surface automatic cleaning apparatus according to claim 1, wherein the anti-leakage baffle is rotatably connected to the main body.

3. The water surface automatic cleaning apparatus according to claim 2, wherein a side of the anti-leakage baffle is hinged to the inlet through the shaft lever to drive the anti-leakage baffle to rotate around an axis of the shaft lever.

4. The water surface automatic cleaning apparatus according to claim 3, wherein the anti-leakage baffle is configured to rotate by a push of water flow when the water surface automatic cleaning apparatus moves forward on a water surface, to open at least a part of the area of the inlet.

5. The water surface automatic cleaning apparatus according to claim 2, further comprising:

a limit part arranged on the main body or the garbage bin, and configured to limit a rotation range of the anti-leakage baffle.

6. The water surface automatic cleaning apparatus according to claim 2, wherein a free end of the anti-leakage baffle is above a water line when at least a part of the area of the inlet is closed by the anti-leakage baffle.

7. The water surface automatic cleaning apparatus according to claim 2, wherein an air chamber is arranged on the anti-leakage baffle, or a counterweight is arranged on the anti-leakage baffle, or an air chamber and a counterweight are arranged on the anti-leakage baffle.

8. The water surface automatic cleaning apparatus according to claim 1, wherein the anti-leakage baffle is configured to reset by a buoyancy in water when the water surface automatic cleaning apparatus stops moving forward on a water surface, to close at least a part of the area of the inlet.

9. The water surface automatic cleaning apparatus according to claim 1, wherein when the rotating element rotates for collecting floating objects, the anti-leakage baffle is in an open state.

10. The water surface automatic cleaning apparatus according to claim 9, wherein when the water surface automatic cleaning apparatus stops collecting floating objects, the anti-leakage baffle is in a closed state.

11. The water surface automatic cleaning apparatus according to claim 1, wherein at least a part of the rotating element is above the anti-leakage baffle.

12. The water surface automatic cleaning apparatus according to claim 1, wherein the anti-leakage baffle and the rotating element are configured such that during a rotation of the anti-leakage baffle, a free end of the anti-leakage baffle does not contact brush blades of the rotating element even when the free end of the anti-leakage baffle is closest to the brush blades of the rotating element.

13. The water surface automatic cleaning apparatus according to claim 1, further comprising:

at least one power component configured to drive the anti-leakage baffle to rotate, or at least one power component configured to drive the rotating element to rotate, or at least one power component configured to drive the anti-leakage baffle and the rotating element to rotate.

14. The water surface automatic cleaning apparatus according to claim 13, wherein the at least one power component comprises:

a transmission component configured to drive the anti-leakage baffle to rotate in a direction covering the inlet, and to drive the rotating element to rotate in a direction same as or opposite to the direction of a rotation of the anti-leakage baffle.

15. The water surface automatic cleaning apparatus according to claim 13, wherein the at least one power component comprises a first power component for driving the anti-leakage baffle and a second power component for driving the rotating element.

16. The water surface automatic cleaning apparatus according to claim 1, wherein the garbage bin comprises a body and a flap, and the flap rotates to open or close an opening located at a bottom of the body.

17. A water surface automatic cleaning apparatus, comprising:

a main body comprising a cavity inside;

a garbage bin arranged in the cavity and comprising an inlet on a side of the garbage bin; wherein the garbage bin is able to be taken out from the cavity;

an anti-leakage baffle arranged on the main body, and the anti-leakage baffle being configured to allow to open or close at least a part of an area of the inlet by rotating;

a rotating element arranged near to the inlet on the main body and configured to feed garbage in water into the garbage bin by rotating, wherein in a direction parallel to a forward direction of the water surface automatic cleaning apparatus, a shaft lever for the anti-leakage baffle does not directly face the rotating element; and a solar panel arranged on a top of the main body.

18. The water surface automatic cleaning apparatus according to claim 1, wherein a shaft of the rotating element is parallel to the shaft lever for the anti-leakage baffle.

19. The water surface automatic cleaning apparatus according to claim 17, wherein a shaft of the rotating element is parallel to the shaft lever for the anti-leakage baffle.

20. A water surface automatic cleaning apparatus, comprising:

a main body comprising a cavity inside;

a garbage bin arranged in the cavity and comprising an inlet on a side of the garbage bin;

an anti-leakage baffle arranged on the main body, and the anti-leakage baffle being configured to allow to open or close at least a part of an area of the inlet by rotating; and a rotating element arranged near to the inlet on the main body and configured to feed garbage in water into the garbage bin by rotating, wherein in a case where the anti-leakage baffle closes the at least a part of an area of the inlet, in a forward direction of the water surface automatic cleaning apparatus, a free end of the anti-leakage baffle is not covered.

21. The water surface automatic cleaning apparatus according to claim 20, wherein the shaft lever for the anti-leakage baffle comprises a part which connects to a side of the anti-leakage baffle.

* * * * *